US010159386B2

(12) United States Patent
Hung et al.

(10) Patent No.: US 10,159,386 B2
(45) Date of Patent: Dec. 25, 2018

(54) FACE CLEANING APPARATUS

(71) Applicant: CAL-COMP ELECTRONICS & COMMUNICATIONS COMPANY LIMITED, New Taipei (TW)

(72) Inventors: Ming-Hua Hung, New Taipei (TW); Tung-Kai Tsai, New Taipei (TW)

(73) Assignee: CAL-COMP ELECTRONICS & COMMUNICATIONS COMPANY LIMITED, New Taipei (TW)

( * ) Notice: Subject to any disclaimer, the term of this patent is extended or adjusted under 35 U.S.C. 154(b) by 331 days.

(21) Appl. No.: 15/150,894

(22) Filed: May 10, 2016

(65) Prior Publication Data

US 2017/0273514 A1 Sep. 28, 2017

(30) Foreign Application Priority Data

Mar. 25, 2016 (CN) ..... 2016 1 0175055

(51) Int. Cl.

| | |
|---|---|
| ***A47K 7/02*** | (2006.01) |
| ***A46B 13/00*** | (2006.01) |
| ***A47K 7/04*** | (2006.01) |
| ***A46B 13/02*** | (2006.01) |

(52) U.S. Cl.

CPC ..... *A47K 7/02* (2013.01); *A46B 13/008* (2013.01); *A46B 13/02* (2013.01); *A47K 7/04* (2013.01); *A46B 2200/1006* (2013.01)

(58) Field of Classification Search

CPC ..... A46B 13/008; A46B 13/02; A46B 2200/1006; A47K 7/02; A47K 7/04

See application file for complete search history.

(56) References Cited

U.S. PATENT DOCUMENTS

| | | | | |
|---|---|---|---|---|
| 8,365,335 B2 * | 2/2013 | Fischer | ..... | A61C 17/34 15/22.1 |
| 2005/0199265 A1 * | 9/2005 | France | ..... | A46B 9/00 134/6 |
| 2006/0179591 A1 * | 8/2006 | Spooner | ..... | A46B 13/008 15/22.2 |

(Continued)

FOREIGN PATENT DOCUMENTS

| | | | | |
|---|---|---|---|---|
| CN | 104825243 A | * | 8/2015 | |
| KR | 20150117405 A | * | 10/2015 | |
| WO | WO 2004098445 A1 | * | 11/2004 | ..... A61C 17/222 |

*Primary Examiner* — Marc Carlson

(74) *Attorney, Agent, or Firm* — Chun-Ming Shih; HDLS IPR Services

(57) ABSTRACT

A face cleaning apparatus includes a brush head, a case, a transmission shaft, and an eccentric wheel module. The case has a throughhole. The transmission shaft is disposed within the case and has a shaft body having an oscillating end and a protrusion extending along an axial surface. The oscillating end is disposed axially through the throughhole and connected to the brush head. The eccentric wheel module is disposed within the case and includes a motor and an eccentric wheel rotated by the motor. The protrusion is pressed against a side of the eccentric wheel and reciprocates following rotation of the eccentric wheel such that the oscillating end is driven to oscillate with respect to the case. Therefore, the face cleaning apparatus has the advantages of low vibration, low noise, increased battery life, and simple assembly.

9 Claims, 12 Drawing Sheets

(56) References Cited

U.S. PATENT DOCUMENTS

| | | | | |
|---|---|---|---|---|
| 2007/0084002 | A1* | 4/2007 | Drossler | A61C 17/3436 15/22.1 |
| 2008/0222822 | A1* | 9/2008 | Cobabe | A46B 5/0075 15/28 |
| 2012/0165710 | A1* | 6/2012 | Nichols | A61H 7/005 601/72 |
| 2012/0216831 | A1* | 8/2012 | Cobabe | A46B 13/008 134/6 |
| 2015/0289958 | A1* | 10/2015 | Fischer | A61C 17/34 15/22.1 |
| 2016/0045081 | A1* | 2/2016 | Kern | A47K 7/043 15/22.4 |
| 2016/0270821 | A1* | 9/2016 | Hendler | A61B 17/54 |
| 2017/0049278 | A1* | 2/2017 | Thomassen | A61H 7/005 |

* cited by examiner

FACE CLEANING APPARATUS

BACKGROUND OF THE INVENTION

Field of the Invention

The present invention relates to a face cleaning apparatus and in particular to a face washing machine structure.

Description of Prior Art

To clean the skin more effectively, an electric face washing device in the market uses the magnetic force induced by the interaction between an electromagnet and a magnet seat to drive a brush with supersonic vibration. Then the vibrating brush is applied on the face to stir the facial cleanser quickly to generate fine foam which can permeate into the skin surface to clean the skin more effectively.

However, the above-mentioned electric face washing device has the following disadvantages. Using the magnetic force induced by the interaction between the electromagnet and the magnet seat results in an excessive volume of the electric face washing device. Also, the magnetic force must overcome the strength of the iron piece of the magnet seat to drive the brush to oscillate during the driving process of the electromagnet. However, the excessive driving force will vibrate the whole device, which causes high energy consumption, undesired vibration, and loud noise. Further, the hand holding the device for a while may feel numb.

In view of this, the inventor pays special attention to research with the application of related theory and tries to improve and overcome the above disadvantages regarding the above related art, which becomes the improvement target of the inventor.

SUMMARY OF THE INVENTION

The present invention provides a face cleaning apparatus which uses an eccentric wheel module to replace the component of the traditional magnet seat to gain the advantages of low vibration, low noise, increased battery life, and simple assembly.

In the embodiments, the present invention provides a face cleaning apparatus comprising a brush head, a case, a transmission shaft, and an eccentric wheel module. The case has a throughhole. The transmission shaft is disposed within the case. The transmission shaft has a shaft body having an oscillating end and a protrusion extending along an axial surface. The oscillating end is disposed axially through the throughhole and connected to the brush head. The eccentric wheel module is disposed within the case. The eccentric wheel module comprises a motor and an eccentric wheel driven to rotate by the motor. The protrusion is pressed against a side of the eccentric wheel and reciprocates following rotation of the eccentric wheel such that the oscillating end is driven to oscillate with respect to the case.

According to the above description, the eccentric wheel module of the present invention drives the shaft body to reciprocate, which has the feature of low friction to enhance the driving force. Thus, the effects of power saving operation, low vibration, and low noise can be achieved.

According to the above description, the traditional magnet seat may cause concern about deformation of the iron piece thereof and the poor assembly may form gaps of different sizes between magnets. However, the eccentric wheel module of the present invention does not have concern about deformation, which can improve the lifetime and is easy for assembly.

According to the above description, the rotating axis of the eccentric wheel is substantially disposed perpendicular to the central axis of the transmission shaft, which smoothly transforms the spinning motion of the eccentric wheel into the oscillating motion of the oscillating end such that the face cleaning apparatus has the function of oscillating cleaning.

DETAILED DESCRIPTION OF THE INVENTION

Figure 1:
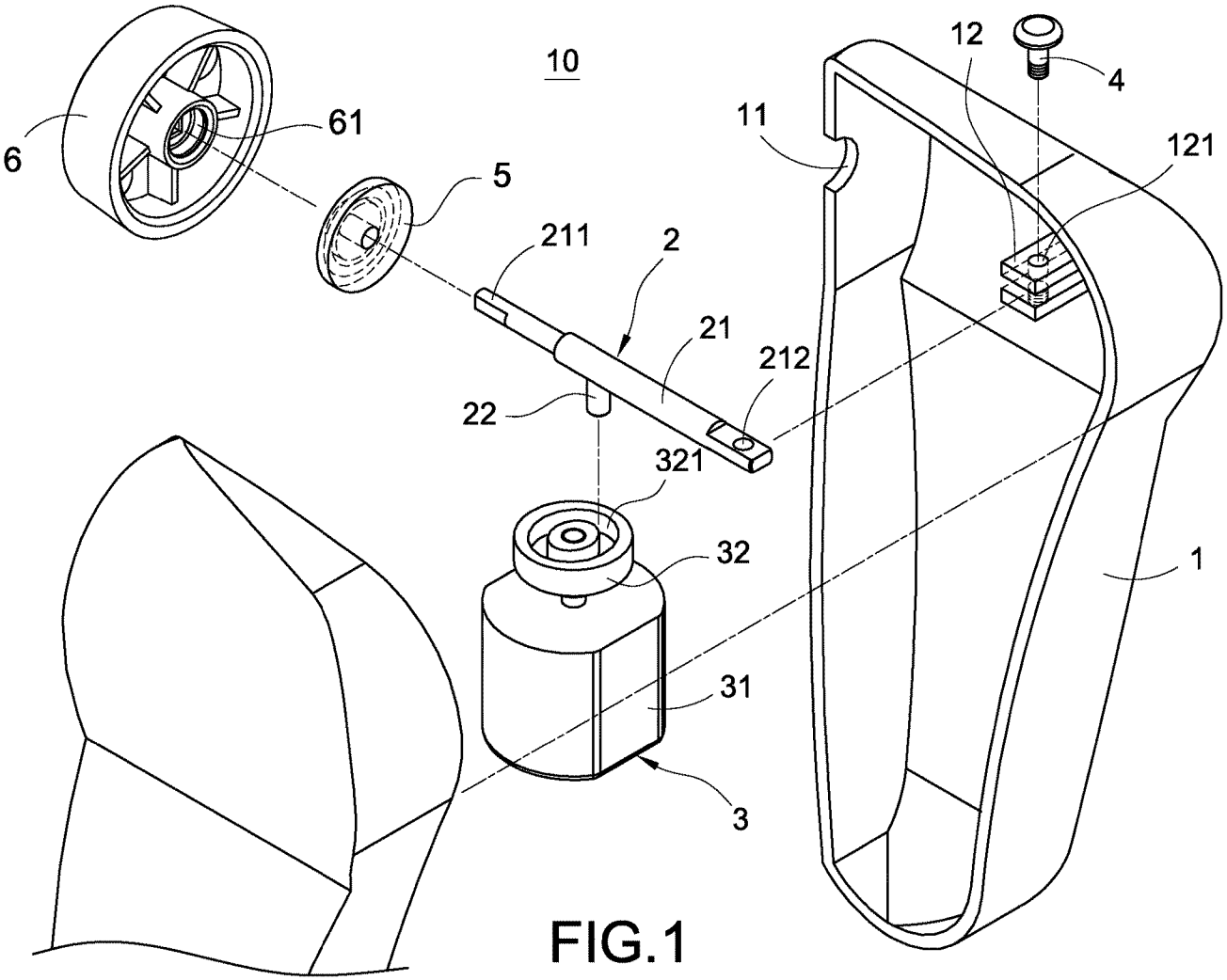
FIG. 1 is a perspective exploded view of the face cleaning apparatus according to the first embodiment of the present invention.

The detailed description and technical details of the present invention will be explained below with reference to accompanying figures. However, the accompanying figures are only for reference and explanation, but not to limit the scope of the present invention.

Please refer to FIGS. 1-4. The present invention provides a face cleaning apparatus according to the first embodiment of the present invention. The face cleaning apparatus 10 comprises a brush head 6, a case 1, a transmission shaft 2, and an eccentric wheel module 3.

Figure 2:
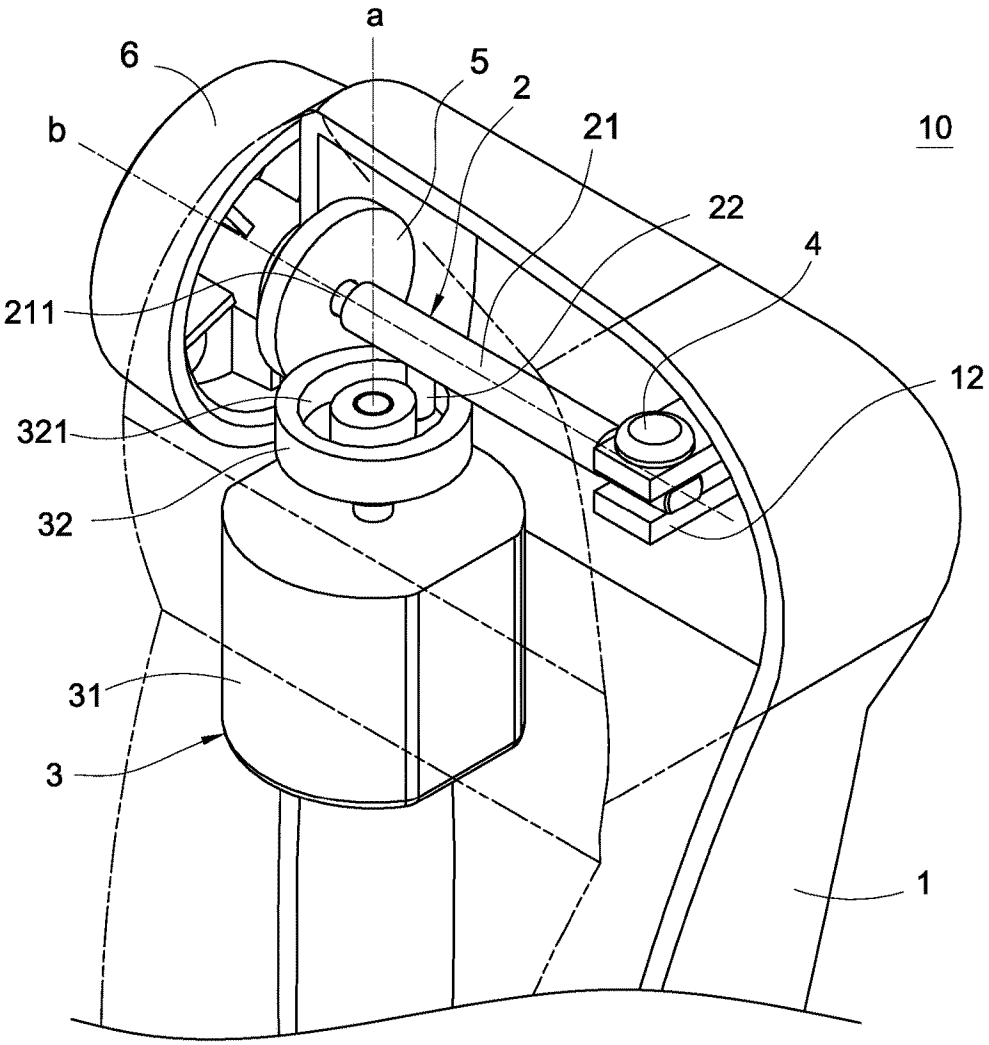
FIG. 2 is a perspective assembled view of the face cleaning apparatus according to the first embodiment of the present invention.
Figure 3:
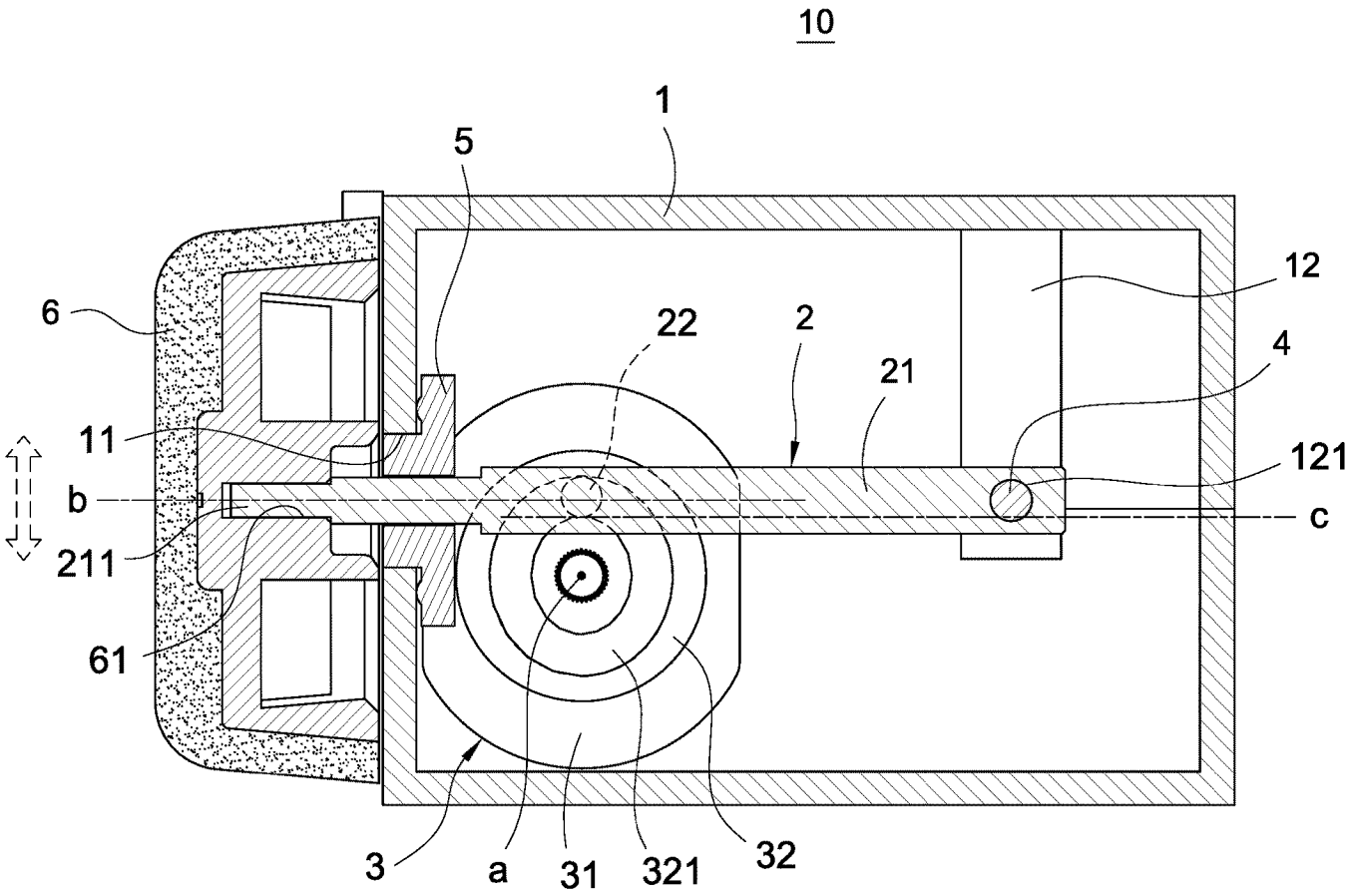
FIG. 3 is a schematic view of the face cleaning apparatus according to the first embodiment of the present invention in operation.

As shown in FIGS. 1-3, the case 1 has a throughhole 11. A connecting block 12 extends within the case 1 and has a first pivot hole 121.

As shown in FIGS. 1-3, the transmission shaft 2 is disposed within the case 1. The transmission shaft 2 has a shaft body 21 having an oscillating end 211, a second pivot hole 212, and a protrusion 22 extending along an axial surface. The oscillating end 211 is disposed axially through the throughhole 11 and connected to the brush head 6.

As shown in FIGS. 1-4, the eccentric wheel module 3 is disposed within the case 1. The eccentric wheel module 3 comprises a motor 31 and an eccentric wheel 32 driven to rotate by the motor 31. The eccentric wheel 32 rotates around a rotating axis a. The rotating axis a of the eccentric wheel 32 is substantially disposed perpendicular to a central axis b of the transmission shaft 2. The protrusion 22 is pressed against a side of the eccentric wheel 32 and reciprocates following rotation of the eccentric wheel 32 such that the oscillating end 211 is driven to oscillate with respect to the case 1.

The detailed description is given below. The eccentric wheel 32 in the current embodiment has a non-circular looped groove 321 centered around the rotating axis a. The protrusion 22 is embedded and slides in the non-circular looped groove 321. A tangent line c is defined by mutual contact of the protrusion 22 and the eccentric wheel 32; the tangent line c is substantially disposed parallel with the central axis b.

Besides, the non-circular looped groove 321 in the current embodiment is an ellipse looped groove, but not limited to this. The non-circular looped groove 321 can be a looped groove having any geometric shape besides a triangle, a square, or a polygon.

As shown in FIGS. 1-3, the face cleaning apparatus 10 of the present invention further comprises a pivot pin 4 which is pivoted to the first pivot hole 121 and the second pivot hole 212 such that the shaft body 21 can oscillate with respect to the pivot pin 4 serving as a pivot point.

As shown in FIGS. 1-3, the face cleaning apparatus 10 of the present invention further comprises a waterproof bushing 5 which is clamped between the case 1 and the oscillating end 211 and fills the throughhole 11 such that the face cleaning apparatus 10 is waterproof.

As shown in FIGS. 1-3, the brush head 6 has a plug hole 61. The brush head 6 is sleeved around and fixed to the oscillating end 211 through the plug hole 61. The cross sections of the oscillating end 211 and the plug hole 61 are not circular. Thus, the brush head 6 sleeved around and fixed to the oscillating end 211 through the plug hole 61 can cause the brush head 6 and the oscillating end 211 to be attached to each other and to rotate synchronously.

Figure 4:
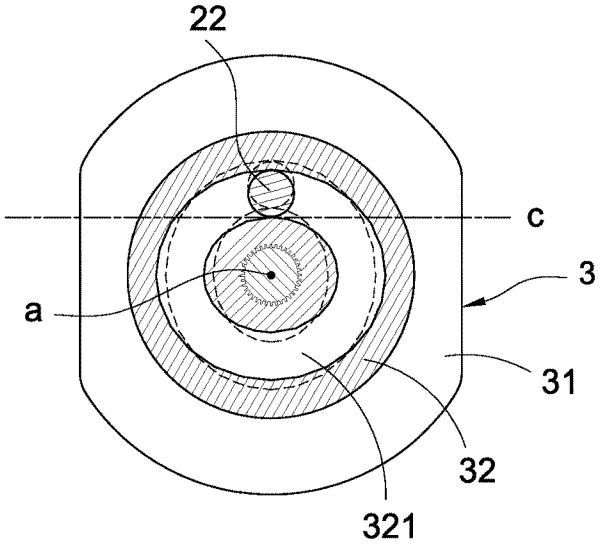
FIG. 4 is another schematic view of the face cleaning apparatus according to the first embodiment of the present invention in operation.

As shown in FIGS. 2-4, the assembly of the face cleaning apparatus 10 of the present invention is given. The case 1 is provided with the throughhole 11. The transmission shaft 2 is disposed within the case 1 and has a shaft body 21 which has the oscillating end 211 and the protrusion 22 extending along an axial surface. The oscillating end 211 is disposed axially through the throughhole 11 and connected to the brush head 6. The eccentric wheel module 3 is disposed within the case 1 and comprises a motor 31 and an eccentric wheel 32 driven to rotate by the motor 31. The protrusion 22 is pressed against a side of the eccentric wheel 32 and reciprocates following rotation of the eccentric wheel 32 such that the oscillating end 211 is driven to oscillate with respect to the case 1. In this way, the eccentric wheel module 3 can replace the component of the traditional magnet seat such that the face cleaning apparatus 10 can gain the advantages of low vibration, low noise, increased battery life, and simple assembly.

As shown in FIGS. 3-4, the operation of the face cleaning apparatus 10 of the present invention is given. After the face cleaning apparatus 10 is switched on, the AC power source will drive the eccentric wheel module 3 to rotate the eccentric wheel 32. Because the protrusion 22 is pressed against a side of the eccentric wheel 32, the rotation of the eccentric wheel 32 can push against the protrusion 22 to reciprocate and then drive the shaft body 21 and the oscillating end 211 to oscillate following the protrusion 22. Finally, the brush head 6 attached to the oscillating end 211 will reciprocate with the oscillating end 211. The brush head 6 with high-frequency oscillation can stir the facial cleanser quickly to generate fine foam which can permeate into the skin surface to clean the skin more effectively.

Moreover, the process of the eccentric wheel module 3 of the present invention driving the shaft body 21 to reciprocate has the feature of low friction to enhance the driving force. Thus, the effects of power saving operation, low vibration, and low noise can be achieved.

In addition, the traditional magnet seat may cause concern about deformation of the iron piece thereof and the poor assembly may form gaps of different sizes between magnets. However, the above-mentioned eccentric wheel module 3 does not have concern about deformation, which can improve the lifetime and is easy for assembly.

Also, the rotating axis a of the eccentric wheel 32 is substantially disposed perpendicular to the central axis b of the transmission shaft 2. The tangent line c is defined by mutual contact of the protrusion 22 and the eccentric wheel 32; the tangent line c is substantially disposed parallel with the central axis b. Thus, the spinning motion of the eccentric wheel module 3 can be smoothly transformed into the left-and-right oscillation of the oscillating end 211 such that the face cleaning apparatus 10 has the function of oscillating cleaning.

Figure 5:
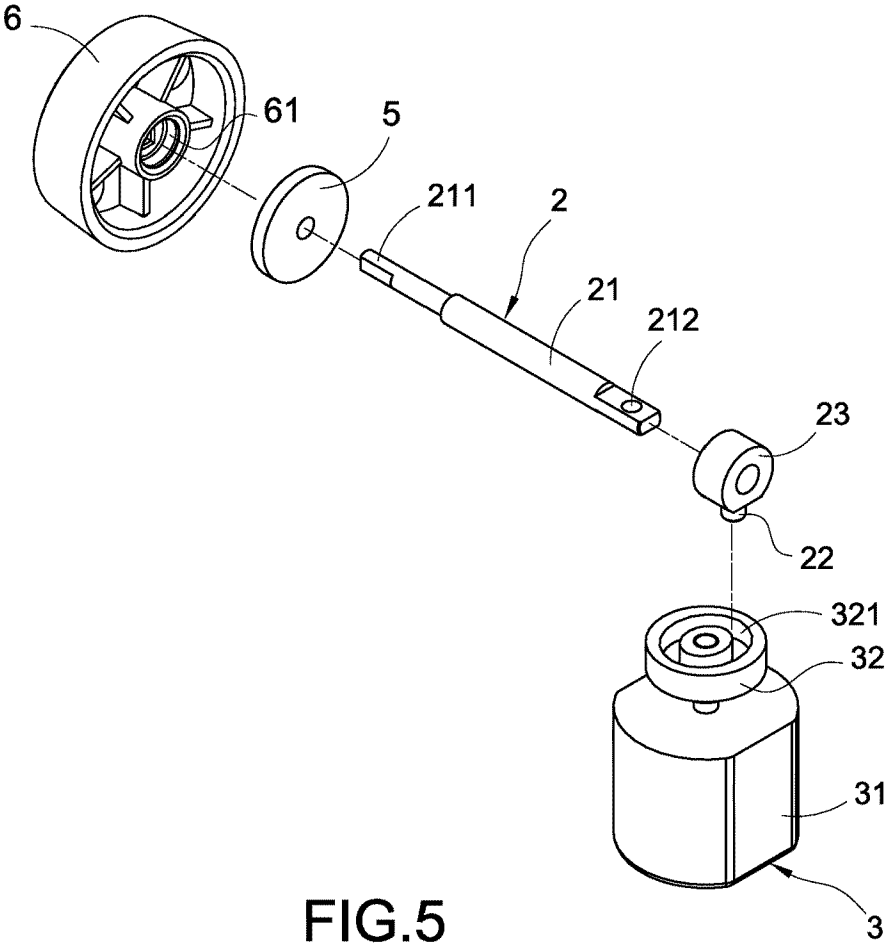
FIG. 5 is a perspective exploded view of the face cleaning apparatus according to the second embodiment of the present invention.
Figure 6:
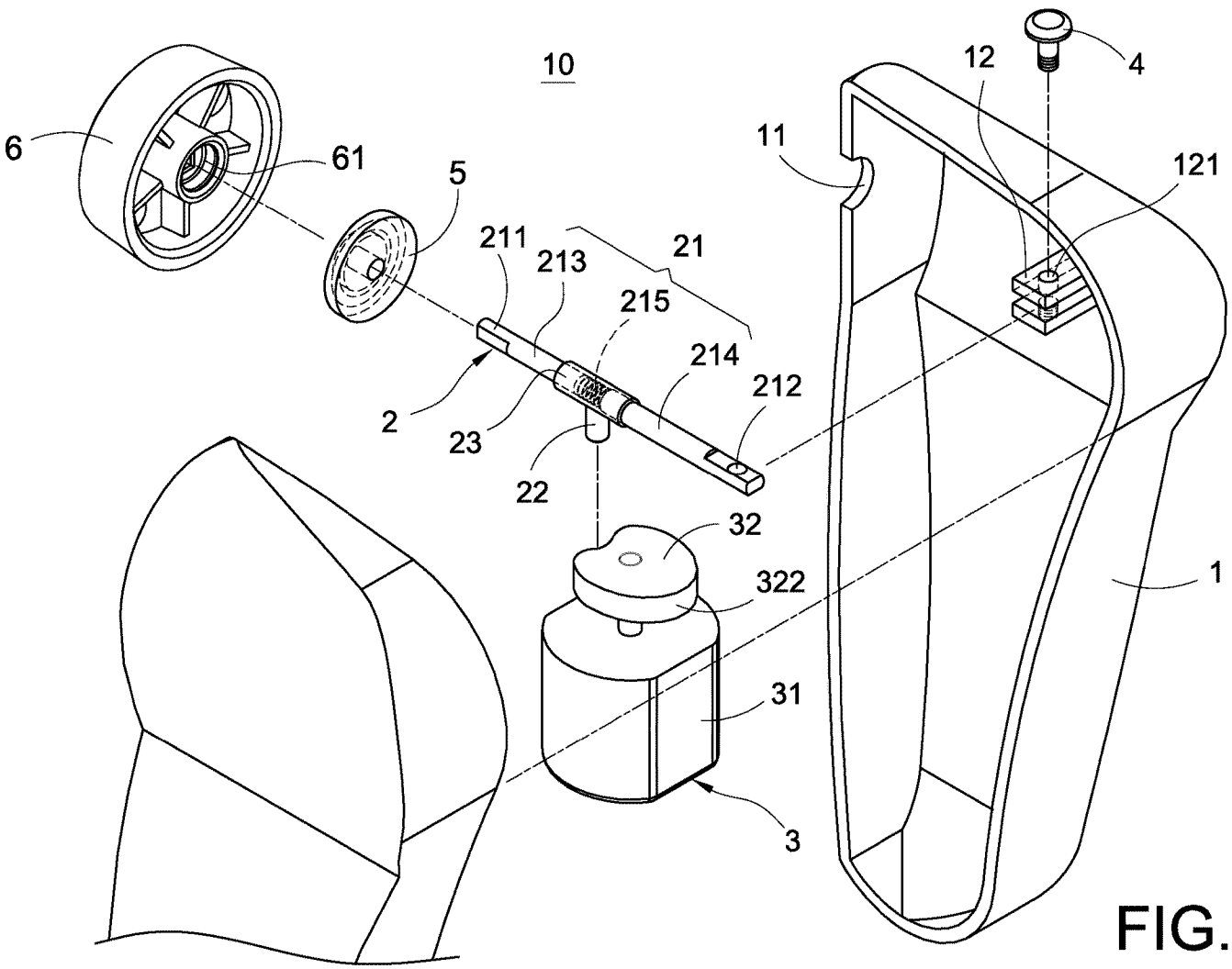
FIG. 6 is a perspective exploded view of the face cleaning apparatus according to the third embodiment of the present invention.
Figure 7:
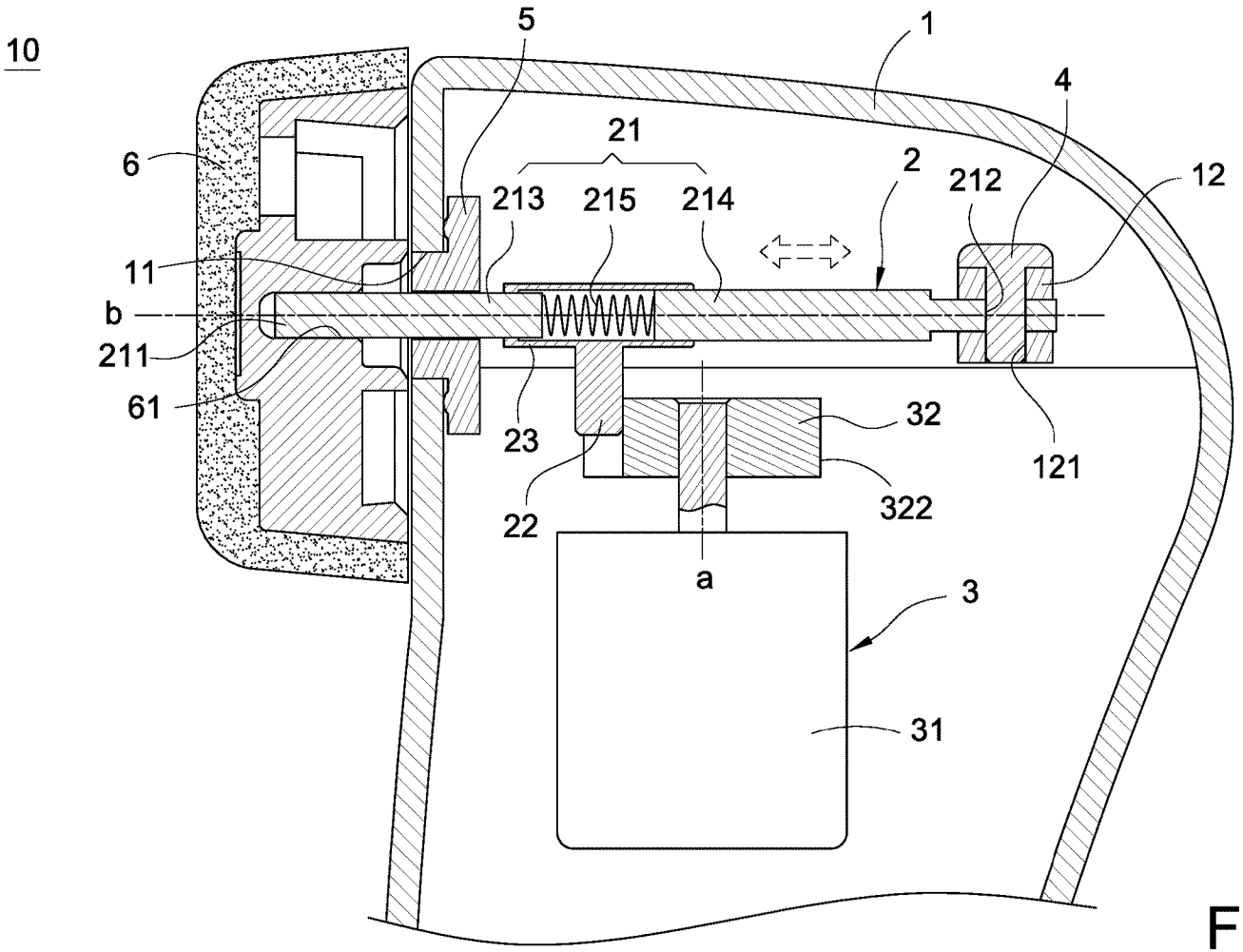
FIG. 7 is a schematic view of the face cleaning apparatus according to the third embodiment of the present invention in operation.
Figure 8:
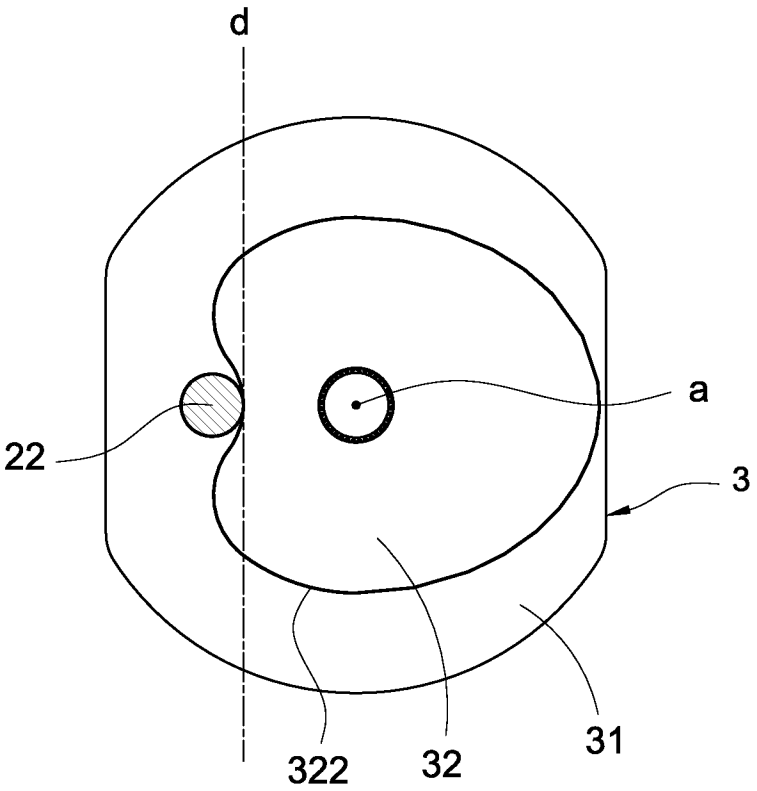
FIG. 8 is another schematic view of the face cleaning apparatus according to the third embodiment of the present invention in operation.

Please refer to FIG. 5, which is a perspective exploded view of the face cleaning apparatus 10 according to the second embodiment of the present invention. The second embodiment is roughly similar to the first embodiment. The difference between them is that the transmission shaft 2 in the second embodiment further comprises a sleeve 23 which is sleeved around the shaft body 21; the protrusion 22 extends from the sleeve 23 and is formed integrally. Thus, the second embodiment and the first embodiment have the same functions and effects Please refer to FIGS. 6-8, which show different views of the face cleaning apparatus 10 according to the third embodiment of the present invention. The third embodiment is roughly similar to the first embodiment. The differences between them are the structures of the eccentric wheel 32 and the shaft body 21.

The further explanation is give below. In the third embodiment, the eccentric wheel 32 has a non-circular looped wall 322 centered around the rotating axis a. The protrusion 22 is pressed against and slides on the non-circular looped wall 322. A tangent line d is defined by mutual contact of the protrusion 22 and the eccentric wheel 32; the tangent line d is substantially disposed perpendicular to the central axis b.

The non-circular looped wall 322 in the third embodiment is a disk-shaped looped wall having a recess on one side thereof, but not limited to this. The non-circular looped wall 322 can be a looped wall having any geometric shape besides a triangle, a square, or a polygon.

Also, the transmission shaft 2 further comprises a sleeve 23 which is sleeved around the shaft body 21. The protrusion 22 extends from the sleeve 23 and is formed integrally. The shaft body 21 comprises a front rod 213, a rear rod 214, and a spring 215. The front rod 213 and the rear rod 214 are individually disposed at two ends of the sleeve 23. The spring 215 is clamped among the front rod 213, the rear rod 214, and the sleeve 23; two ends of the spring 215 are individually fixed to the front rod 213 and the rear rod 214; the oscillating end 211 is formed on the front rod 213. In this way, the front rod 213 and the oscillating end 211 can produce back-and-forth oscillation with respect to the rear rod 214.

Therefore, because the protrusion 22 is pressed against and slides on the non-circular looped wall 322, the rotation of the eccentric wheel 32 can push against the protrusion 22 to reciprocate and then drive the shaft body 21 and the oscillating end 211 to oscillate following the protrusion 22. Besides, the tangent line d is defined by mutual contact of the protrusion 22 and the eccentric wheel 32; the tangent line d is substantially disposed perpendicular to the central axis b. The front rod 213 and the oscillating end 211 can produce back-and-forth oscillation with respect to the rear rod 214, which smoothly transforms the spinning motion of the eccentric wheel 3 into the back-and-forth oscillating motion of the oscillating end 211. Thus, the third embodiment has the functions and effects of the first embodiment.

Figure 9:
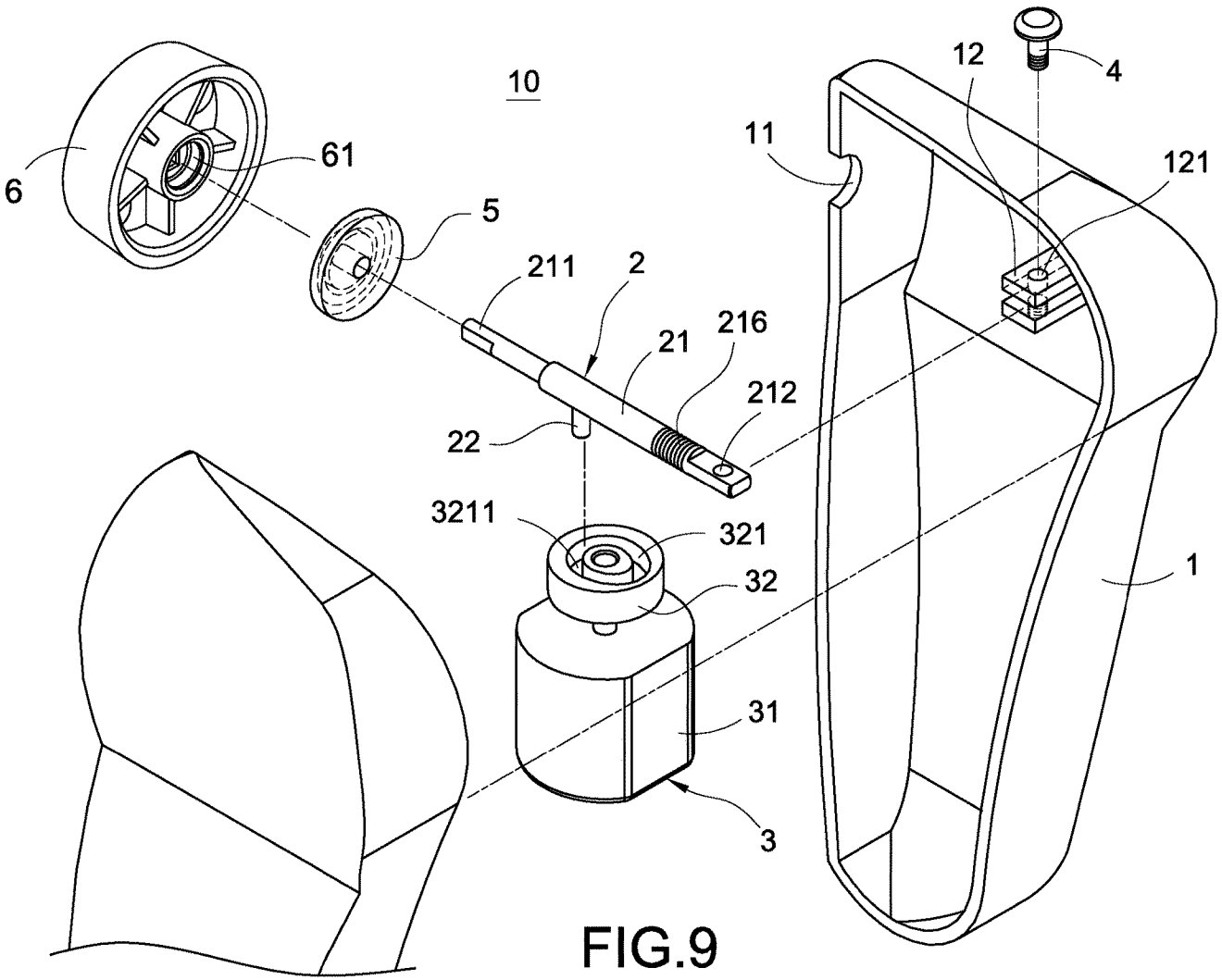
FIG. 9 is a perspective exploded view of the face cleaning apparatus according to the fourth embodiment of the present invention.
Figure 10:
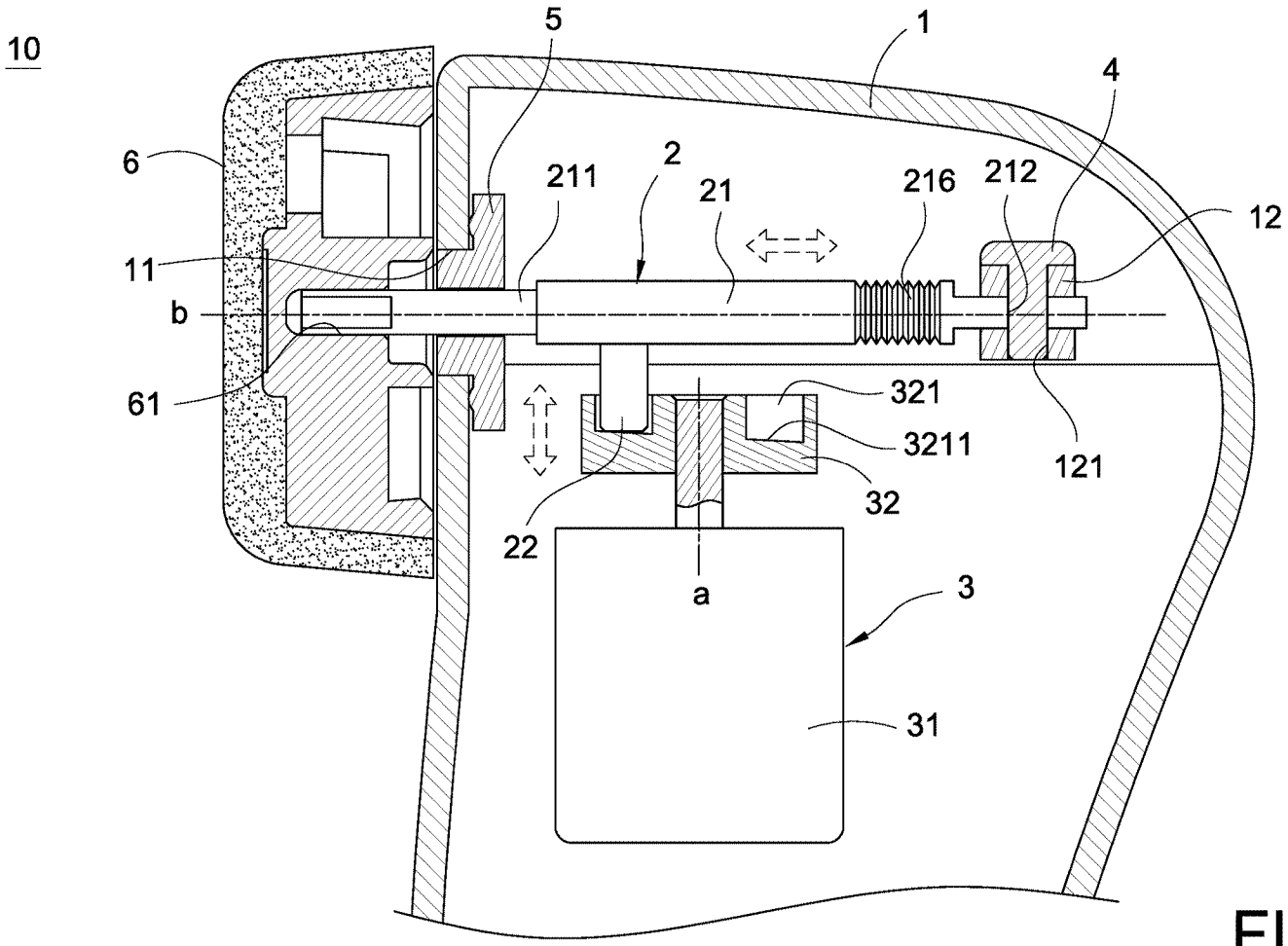
FIG. 10 is a schematic view of the face cleaning apparatus according to the fourth embodiment of the present invention in operation.

Please refer to FIGS. 9 and 10, which show different views of the face cleaning apparatus 10 according to the fourth embodiment of the present invention. The fourth embodiment is roughly similar to the first embodiment. The differences between them are the structures of the eccentric wheel 32 and the shaft body 21.

The detailed explanation is give below. The non-circular looped groove 321 in the fourth embodiment has a sloped bottom wall 3211 whose surface gradually descends from one side to the other side; the protrusion 22 and the sloped bottom wall 3211 are pressed against to each other. Also, the shaft body 21 has a bellow section 216 which is similar to the bellow-shaped section on a bent straw. Thus, the oscillating end 211 can oscillate in universal directions relative to the shaft body 21 such that the rotation of the eccentric wheel 32 can push against the protrusion 22 not only through the inner wall of the non-circular looped groove 321 to produce left-and-right or back-and-forth movements, but through the sloped bottom wall 3211 to produce up-and-down oscillation. Thus, the forth embodiment has the functions and effects of the first embodiment.

Figure 11:
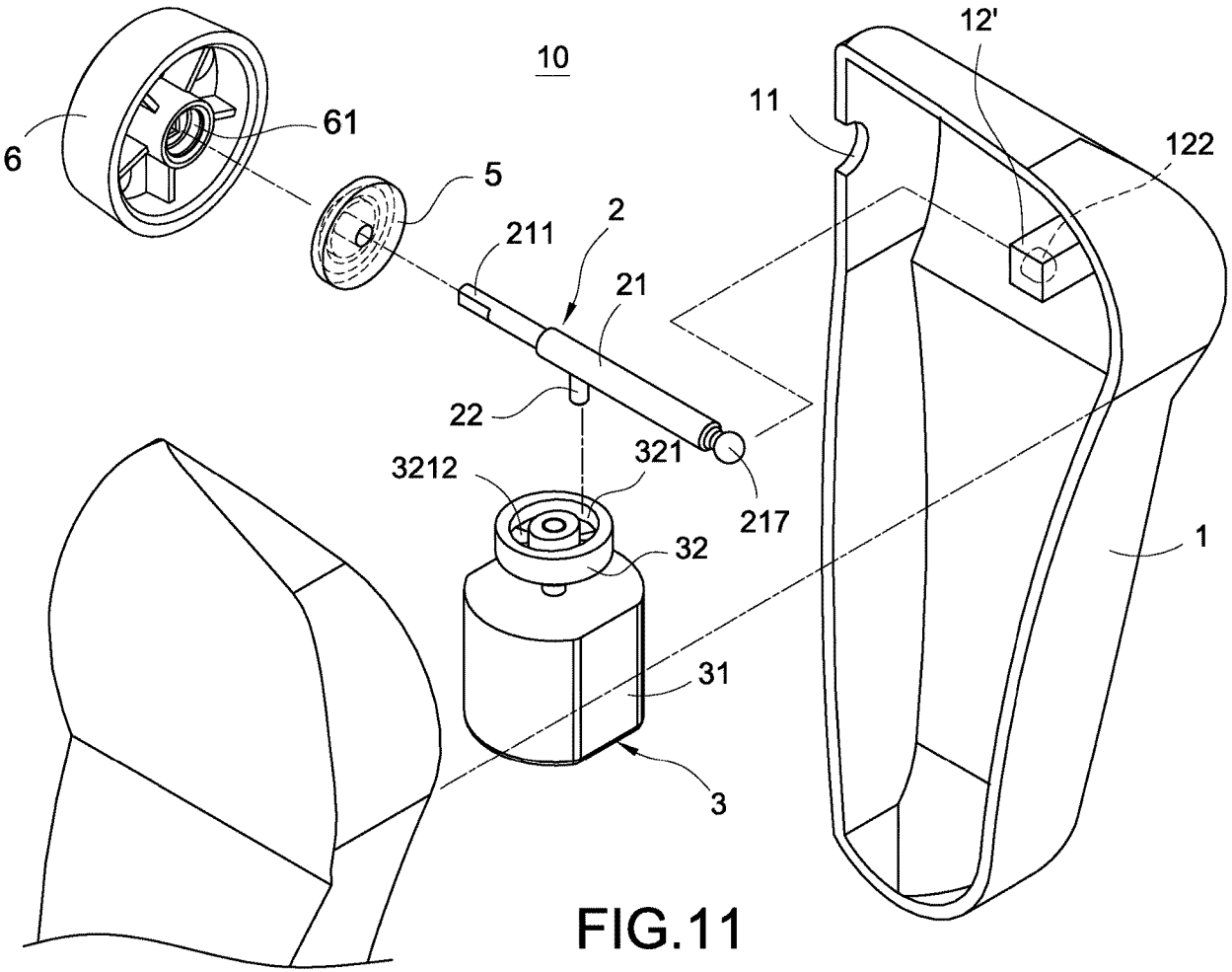
FIG. 11 is a perspective exploded view of the face cleaning apparatus according to the fifth embodiment of the present invention.
Figure 12:
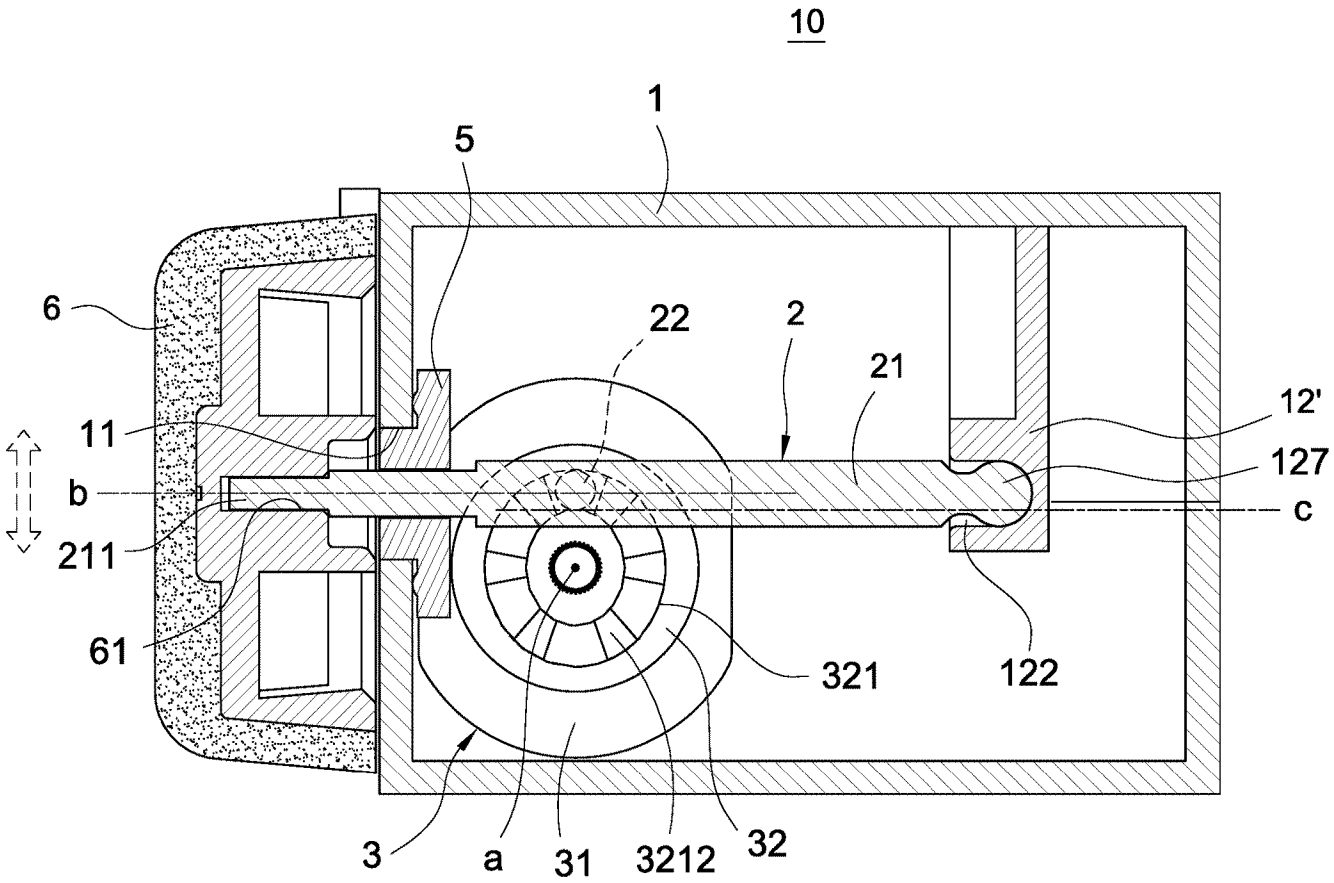
FIG. 12 is a schematic view of the face cleaning apparatus according to the fifth embodiment of the present invention in operation.
Figure 13:
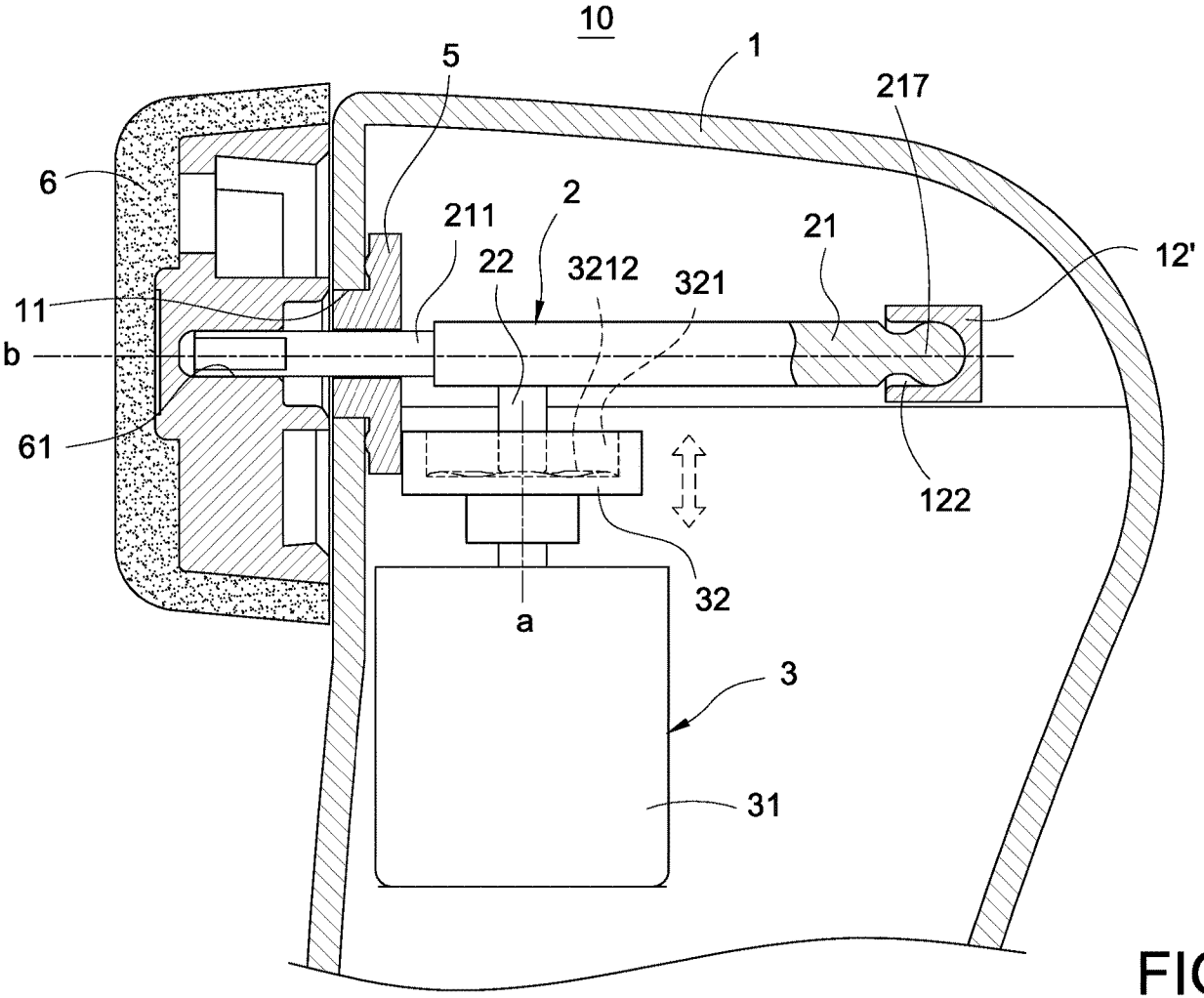
FIG. 13 is another schematic view of the face cleaning apparatus according to the fifth embodiment of the present invention in operation

Please refer to FIGS. 11 and 13, which show different views of the face cleaning apparatus 10 according to the fifth embodiment of the present invention. The fifth embodiment is roughly similar to the first embodiment. The differences between them are the structures of the eccentric wheel 32 and the shaft body 21.

The detailed explanation is give below. The non-circular looped groove 321 in the fifth embodiment has a waved bottom wall 3212; the protrusion 22 and the waved bottom wall 3212 are pressed against to each other. Convex segments and concave segments are formed and spaced on the waved bottom wall 3212. Also, a connecting block 12' extends within the case 1 and has a round pivot hole 122. The shaft body 21 extends to form a spherical connector 217 which is pivoted to the round pivot hole 122. In this way, the oscillating end 211 can oscillate in universal directions relative to the shaft body 21 such that the rotation of the eccentric wheel 32 can push against the protrusion 22 not only through the inner wall of the non-circular looped groove 321 to produce left-and-right or back-and-forth movements, but through the waved bottom wall 3212 to produce up-and-down oscillation. Thus, the fifth embodiment has the functions and effects of the first embodiment.

In summary, the face cleaning apparatus of the present invention has never been anticipated by similar products in the market and used in public. Also, it is indeed novel, useful, and non-obvious to be patentable. Please examine the application carefully and grant it as a formal patent for protecting the rights of the inventor.

What is claimed is:

1. A face cleaning apparatus, comprising:
a brush head;
a case having a throughhole;
a transmission shaft disposed within the case, wherein the transmission shaft has a shaft body having an oscillating end and a protrusion extending along an axial surface, wherein the oscillating end is disposed axially through the throughhole and connected to the brush head; and
an eccentric wheel module disposed within the case, wherein the eccentric wheel module comprises a motor and an eccentric wheel driven to rotate by the motor, wherein the protrusion is pressed against a side of the eccentric wheel and reciprocates following a rotation of the eccentric wheel such that the oscillating end of the shaft body is driven to oscillate with respect to the case,
wherein the eccentric wheel has a rotating axis and a non-circular looped groove centered around the rotating axis, wherein the protrusion is embedded and slides along the non-circular looped groove;
wherein the non-circular looped groove has a sloped shape bottom wall, wherein the protrusion and the sloped shape bottom wall are pressed against to each other.

2. A face cleaning apparatus, comprising:
a brush head;
a case having a throughhole;
a transmission shaft disposed within the case, wherein the transmission shaft has a shaft body having an oscillating end and a protrusion extending along an axial surface, wherein the oscillating end is disposed axially through the throughhole and connected to the brush head; and
an eccentric wheel module disposed within the case, wherein the eccentric wheel module comprises a motor and an eccentric wheel driven to rotate by the motor, wherein the protrusion is pressed against a side of the eccentric wheel and reciprocates following a rotation of the eccentric wheel such that the oscillating end of the shaft body is driven to oscillate with respect to the case;
wherein the eccentric wheel has a rotating axis and a non-circular looped groove centered around the rotating axis, wherein the protrusion is embedded and slides along the non-circular looped groove;
wherein the non-circular looped groove has a waved shape bottom wall, wherein the protrusion and the waved shape bottom wall are pressed against to each other.

3. The face cleaning apparatus according to claim 1, wherein a tangent line is defined by mutual contact of the protrusion and the eccentric wheel, wherein the tangent line is substantially disposed parallel with a central axis of the transmission shaft.

4. The face cleaning apparatus according to claim 1, further comprising a pivot pin, wherein a connecting block extends within the case and has a first pivot hole, wherein the shaft body has a second pivot hole, wherein the pivot pin is pivoted to the first pivot hole and the second pivot hole.

5. The face cleaning apparatus according to claim 1, wherein a rotating axis of the eccentric wheel is substantially disposed perpendicular to a central axis of the transmission shaft.

6. A face cleaning apparatus, comprising:

a brush head;

a case having a throughhole;

a transmission shaft disposed within the case, wherein the transmission shaft has a shaft body having an oscillating end and a protrusion extending along an axial surface, wherein the oscillating end is disposed axially through the throughhole and connected to the brush head; and an eccentric wheel module disposed within the case, wherein the eccentric wheel module comprises a motor and an eccentric wheel driven to rotate by the motor, wherein the protrusion is pressed against a side of the eccentric wheel and reciprocates following a rotation of the eccentric wheel such that the oscillating end of the shaft body is driven to oscillate with respect to the case;

wherein the transmission shaft further comprises a sleeve sleeved around the shaft body, wherein the protrusion extends from the sleeve and is formed integrally;

wherein the shaft body comprises a front rod, a rear rod, and a spring, wherein the front rod and the rear rod are individually disposed at two ends of the sleeve, wherein the spring is clamped among the front rod, the rear rod, and the sleeve and two ends of the spring are individually fixed to the front rod and the rear rod such that the oscillating end is formed on the front rod.

7. The face cleaning apparatus according to claim 1, wherein the shaft body has a bellow section.

8. The face cleaning apparatus according to claim 1, wherein a connecting block extends within the case and has a round pivot hole, wherein the shaft body extends to form a spherical connector, wherein the spherical connector is pivoted to the round pivot hole.

9. The face cleaning apparatus according to claim 1, further comprising a waterproof bushing clamped between the case and the oscillating end and fills the throughhole.

* * * * *